US012604960B2

(12) United States Patent
Clavelle

(10) Patent No.: US 12,604,960 B2
(45) Date of Patent: Apr. 21, 2026

(54) HAIR TWISTING DEVICE AND METHOD OF USE

(71) Applicant: Briant Clavelle, Port Arthur, TX (US)

(72) Inventor: Briant Clavelle, Port Arthur, TX (US)

( * ) Notice: Subject to any disclaimer, the term of this patent is extended or adjusted under 35 U.S.C. 154(b) by 375 days.

(21) Appl. No.: 18/220,049

(22) Filed: Jul. 10, 2023

(65) Prior Publication Data

US 2025/0017344 A1 Jan. 16, 2025

(51) Int. Cl.
*A45D 2/00* (2006.01)

(52) U.S. Cl.
CPC ..... *A45D 2/00* (2013.01); *A45D 2002/005* (2013.01)

(58) Field of Classification Search
CPC ..... A45D 2/00; A45D 2002/005; A45D 2002/006; A45D 2007/004
See application file for complete search history.

(56) References Cited

U.S. PATENT DOCUMENTS 4,038,996 A 8/1977 Eronini
6,575,175 B2 6/2003 Kim
7,069,935 B2 7/2006 Bousfield
7,905,237 B2 3/2011 Noh
9,060,582 B2 * 6/2015 Longoria ..... A45D 2/00
2003/0230316 A1 * 12/2003 Glucksman ..... A45D 2/00 132/212
2018/0098615 A1 * 4/2018 George ..... A46B 5/0095
2022/0346516 A1 * 11/2022 Polidore ..... A45D 20/12

FOREIGN PATENT DOCUMENTS

WO WO0122845 4/2001

* cited by examiner

*Primary Examiner* — Rachel R Steitz

(57) ABSTRACT

A hair twisting device for automated twisting of strands of hair includes a housing, which defines an interior space. A motor is attached to the housing and is positioned in the interior space, with a shaft of the motor extending to proximate to an orifice that is positioned in the housing. A flywheel is attached to the shaft and is rotatable within the orifice. A plurality of couplers is attached to the flywheel, with each coupler being attachable to a respective strand of hair of a user so that each coupler is attached to a strand of hair. The plurality of couplers comprises from two to six couplers. A power module, which is attached to the housing and positioned in the interior space, selectively powers the motor so that rotation of the flywheel imparts a twist to the strands of hair that are attached to the plurality of couplers.

9 Claims, 9 Drawing Sheets

HAIR TWISTING DEVICE AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to hair twisters and more particularly pertains to a new hair twister for automated twisting of strands of hair. Manually twisting of hair can be tiresome and may lead to carpal tunnel syndrome or other issues with hands when performed repeatedly.

(2) Description of Related Art Including Information Disclosed Under 37 CFR 1.97 and 1.98

The prior art relates to hair twisters that are used to impart a twist into multiple strands of hair but does not teach a hair twister having the features disclosed herein.

(h) BRIEF SUMMARY OF THE INVENTION

An embodiment of the disclosure meets the needs presented above by generally comprising a housing, which defines an interior space. A motor is attached to the housing and is positioned in the interior space, with a shaft of the motor extending to proximate to an orifice that is positioned in the housing. A flywheel is attached to the shaft and is rotatable within the orifice. A plurality of couplers is attached to the flywheel, with each coupler being configured to attach to a respective strand of hair of a user so that each coupler is attached to a strand of hair. The plurality of couplers comprises from two to six couplers. A power module is attached to the housing, is positioned in the interior space, and is configured to selectively power the motor so that rotation of the flywheel imparts a twist to the strands of hair that are attached to the plurality of couplers.

Another embodiment of the disclosure includes a method of twisting hair, which entails providing the hair twisting device, according to the disclosure above. Steps of the method are attaching each coupler to a strand of hair, actuating the power module so that rotation of the flywheel imparts a twist to the strands of hair, and detaching the couplers from the strands of hair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
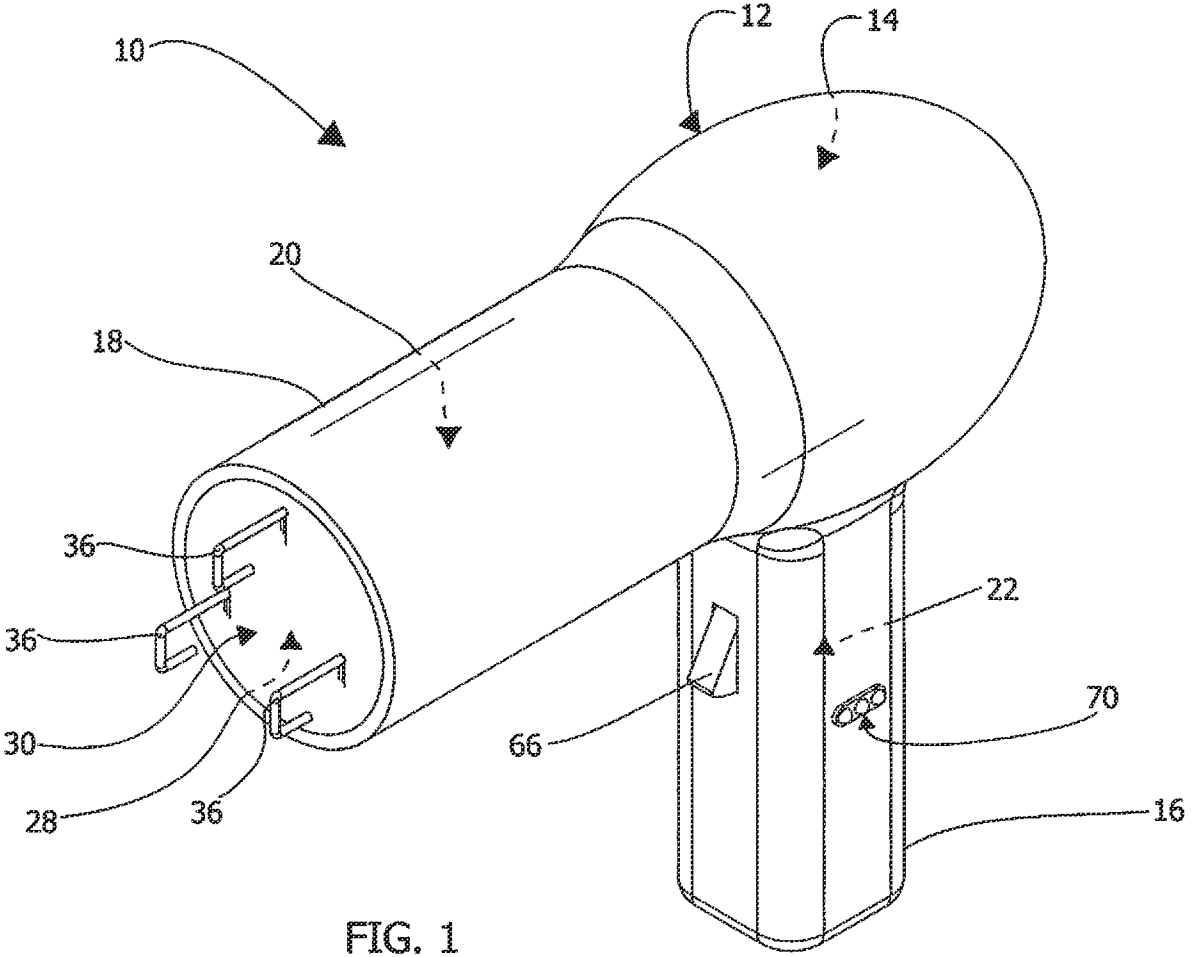
FIG. 1 is an isometric perspective view of a hair twisting device according to an embodiment of the disclosure.

With reference now to the drawings, and in particular to FIGS. 1 through 10 thereof, a new hair twister embodying the principles and concepts of an embodiment of the disclosure and generally designated by the reference numeral 10 will be described.

As best illustrated in FIGS. 1 through 10, the hair twisting device 10 generally comprises a housing 12, which defines an interior space 14. The housing 12 comprises a grip section 16, which is configured to be grasped in a hand of a user, and a tubular section 18, which is attached to and which extends substantially perpendicularly from the grip section 16. The housing 12 thus has a shape akin to that of a standard hair dryer and thus facilitates confident use of the hair twisting device 10.

Figure 2:
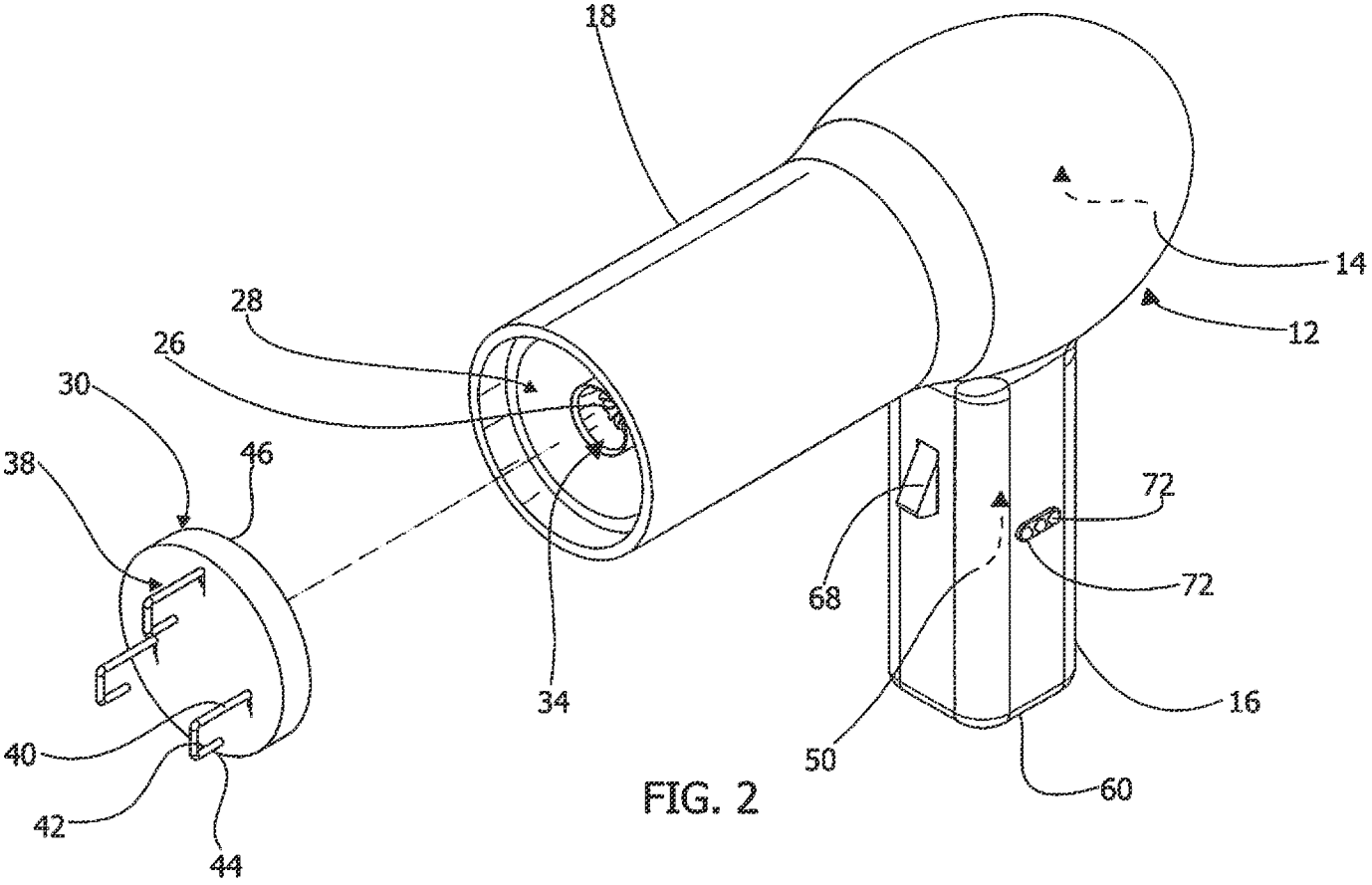
FIG. 2 is an exploded view of an embodiment of the disclosure.
Figure 3:
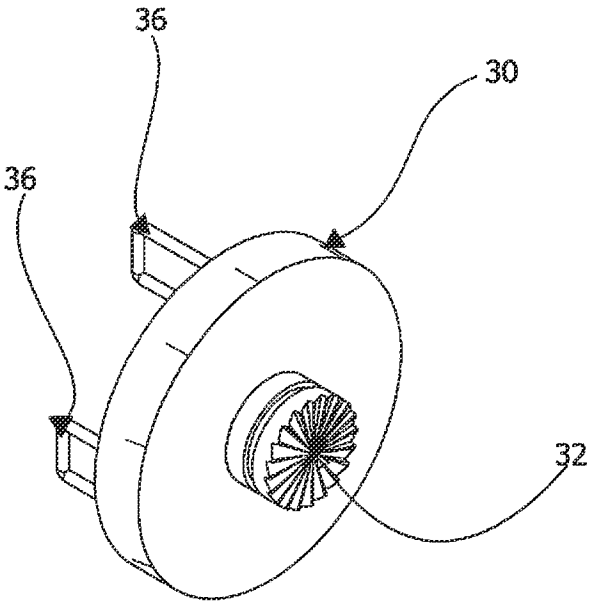
FIG. 3 is a rear detail view of an embodiment of the disclosure.
Figure 5:
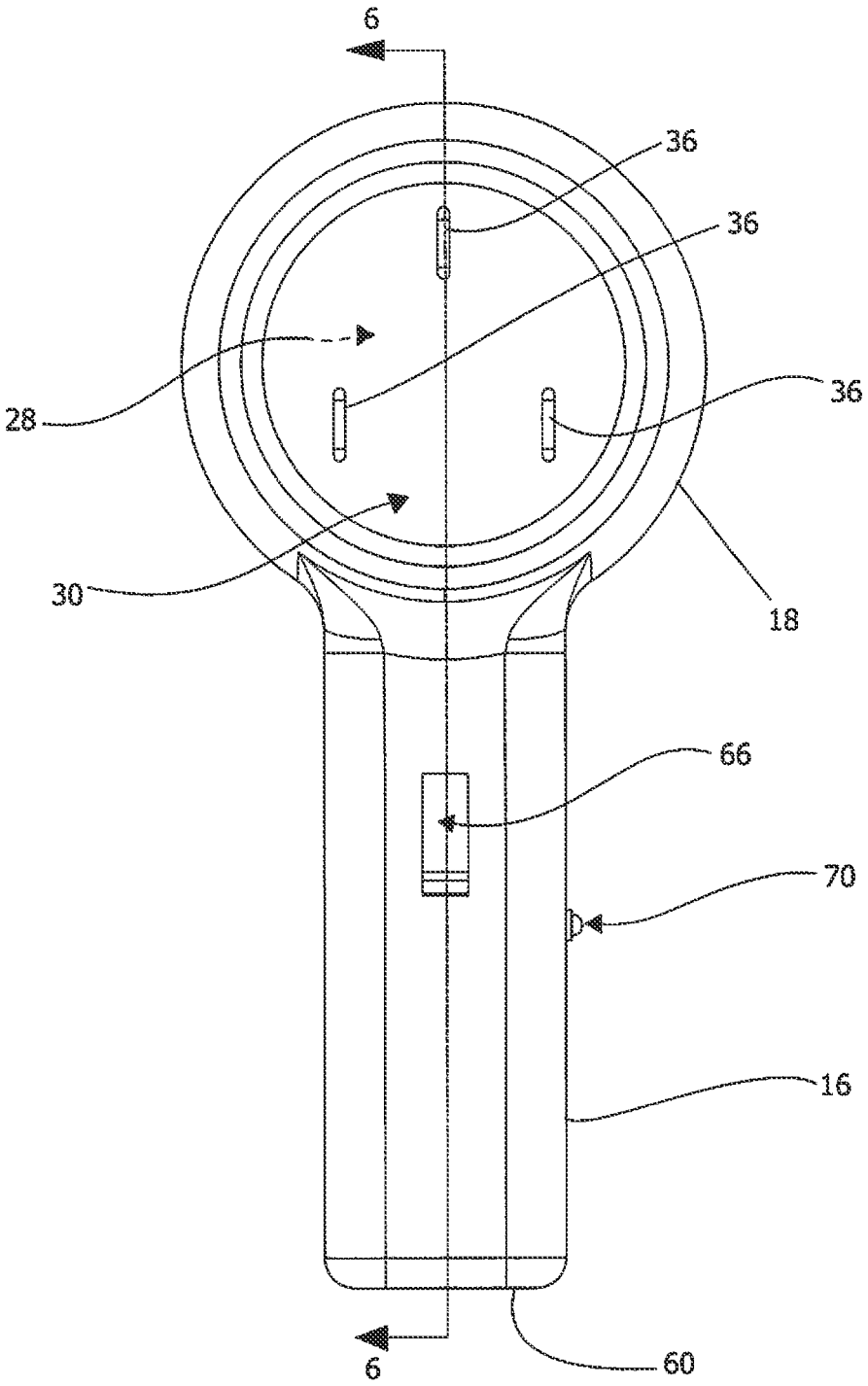
FIG. 5 is a front view of an embodiment of the disclosure.

A motor 20, a power module 22, and a microprocessor 24 are attached to the housing 12 and are positioned in the interior space 14. The microprocessor 24 is operationally engaged to the power module 22 and to the motor 20. A shaft 26 of the motor 20 extends to proximate to an orifice 28 that is positioned in the housing 12. A flywheel 30 is attached to the shaft 26 and is rotatable within the orifice 28. The flywheel 30 may be one of a plurality of flywheels 30, with each flywheel 30 being fitted with a first connector 32 that is attached axially to the flywheel 30, as is shown in FIG. 3. A second connector 34, which is attached to the shaft 26 distal from the motor 20, is complementary to the first connectors 32 so that each flywheel 30 is selectively couplable to the shaft 26, as is shown in FIG. 2. Such connections to shafts are well known in the prior art and may include complementary fittings, magnets, or the like.

A plurality of couplers 36 is attached to the flywheel 30, with each coupler 36 being configured to attach to a respective strand of hair of a user so that each coupler 36 is attached to a strand of hair. The plurality of couplers 36 comprises from two to six couplers 36. Each coupler 36 may comprise a prong 38, which comprises a first section 40, a second section 42, and a third section 44. The first section 40 is attached to and extends perpendicularly from the flywheel 30. The second section 42 is attached to and extends perpendicularly from the first section 40. The third section 44 is attached to and extends perpendicularly from the second section 42 toward the flywheel 30 so that the prong 38 is hook shaped. The present invention anticipates the coupler 36 comprising other coupling means, such as, but not limited to, clips, ties, or the like. The prong 38 could be used to engage a rubber band, clip, or the like, that is attached to the strand of hair.

Figure 4:
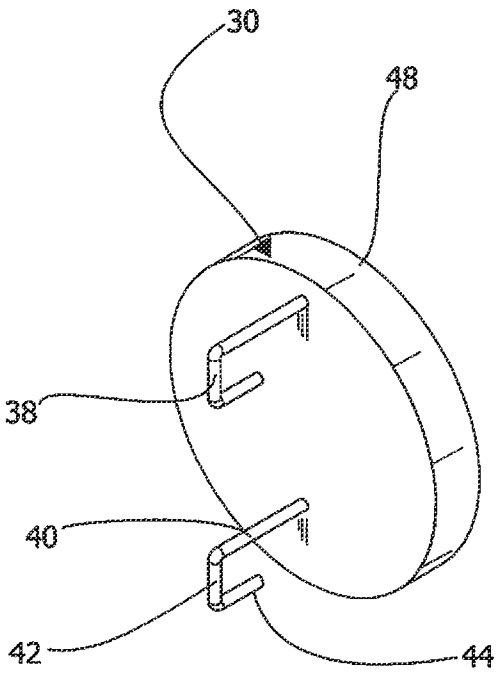
FIG. 4 is a front detail view of an embodiment of the disclosure.

The plurality of flywheels 30 may comprise a first wheel 46, which is fitted with three couplers 36 and which is depicted in FIG. 2, and a second wheel 48, which is fitted with two couplers 36 and which is depicted in FIG. 4. The present invention also anticipates additional flywheels 30 having four, five, or six couplers 36.

Figure 6:
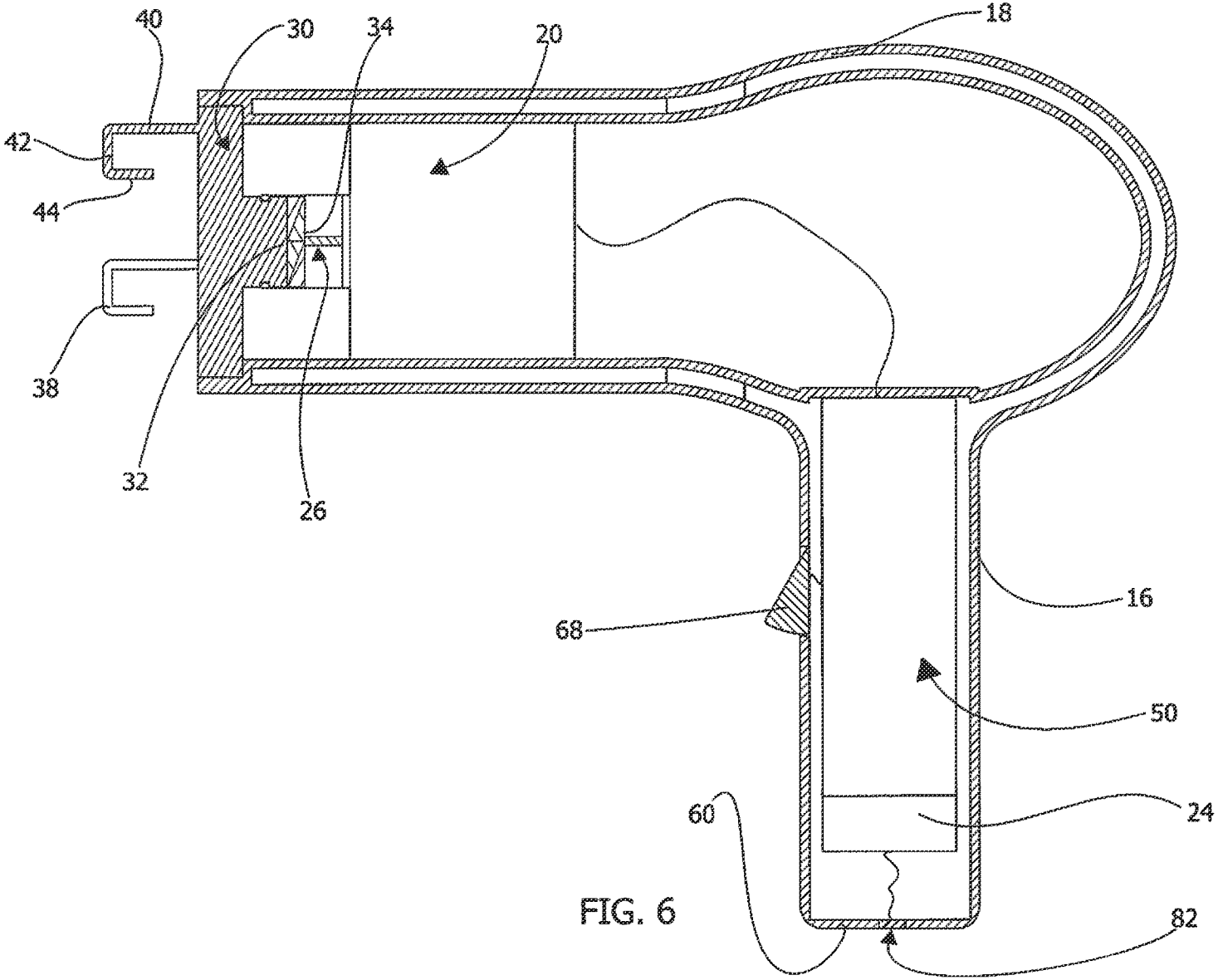
FIG. 6 is a cross-sectional view of an embodiment of the disclosure.
Figure 7:
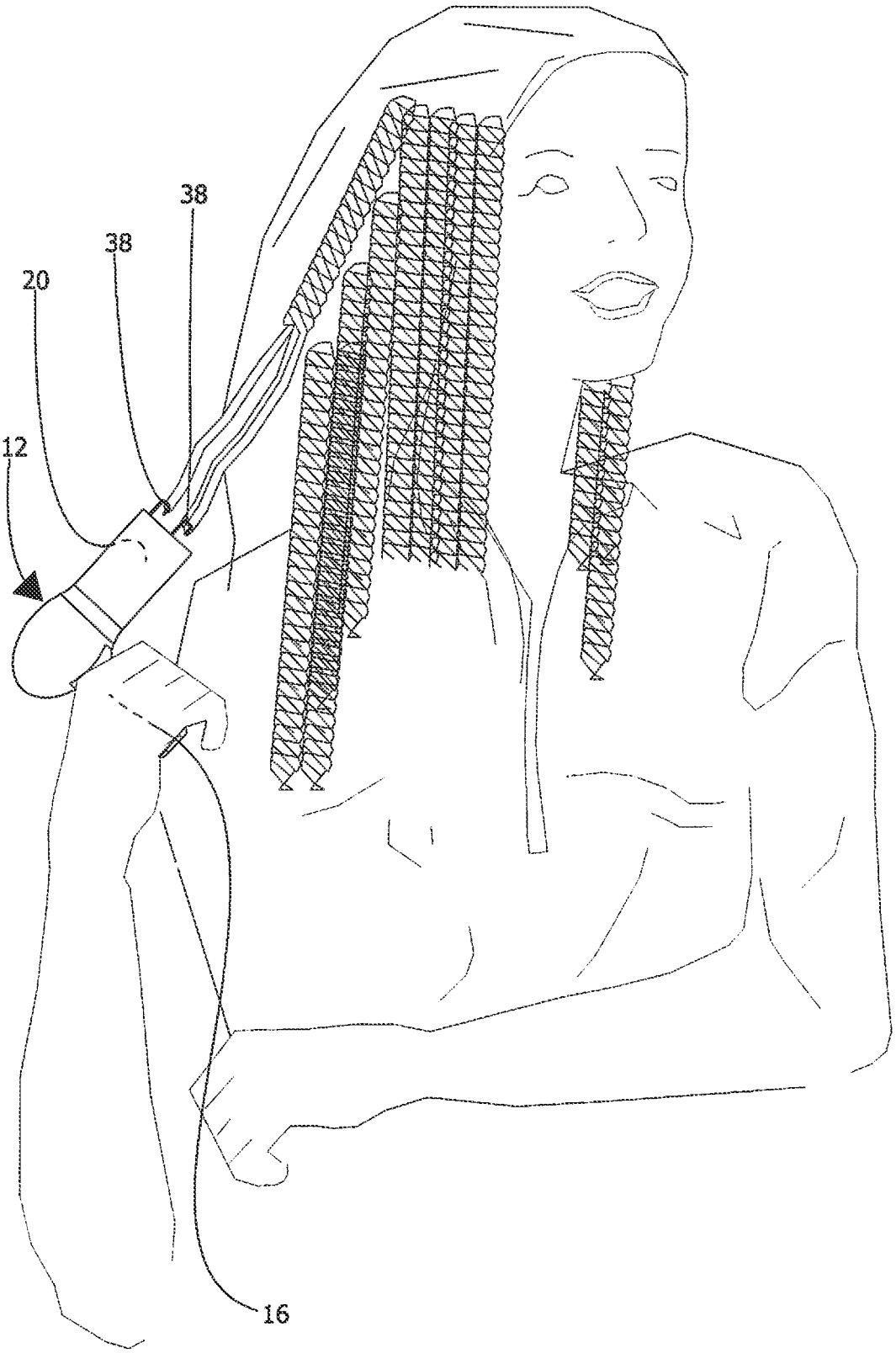
FIG. 7 is an in-use view of an embodiment of the disclosure.
Figure 9:
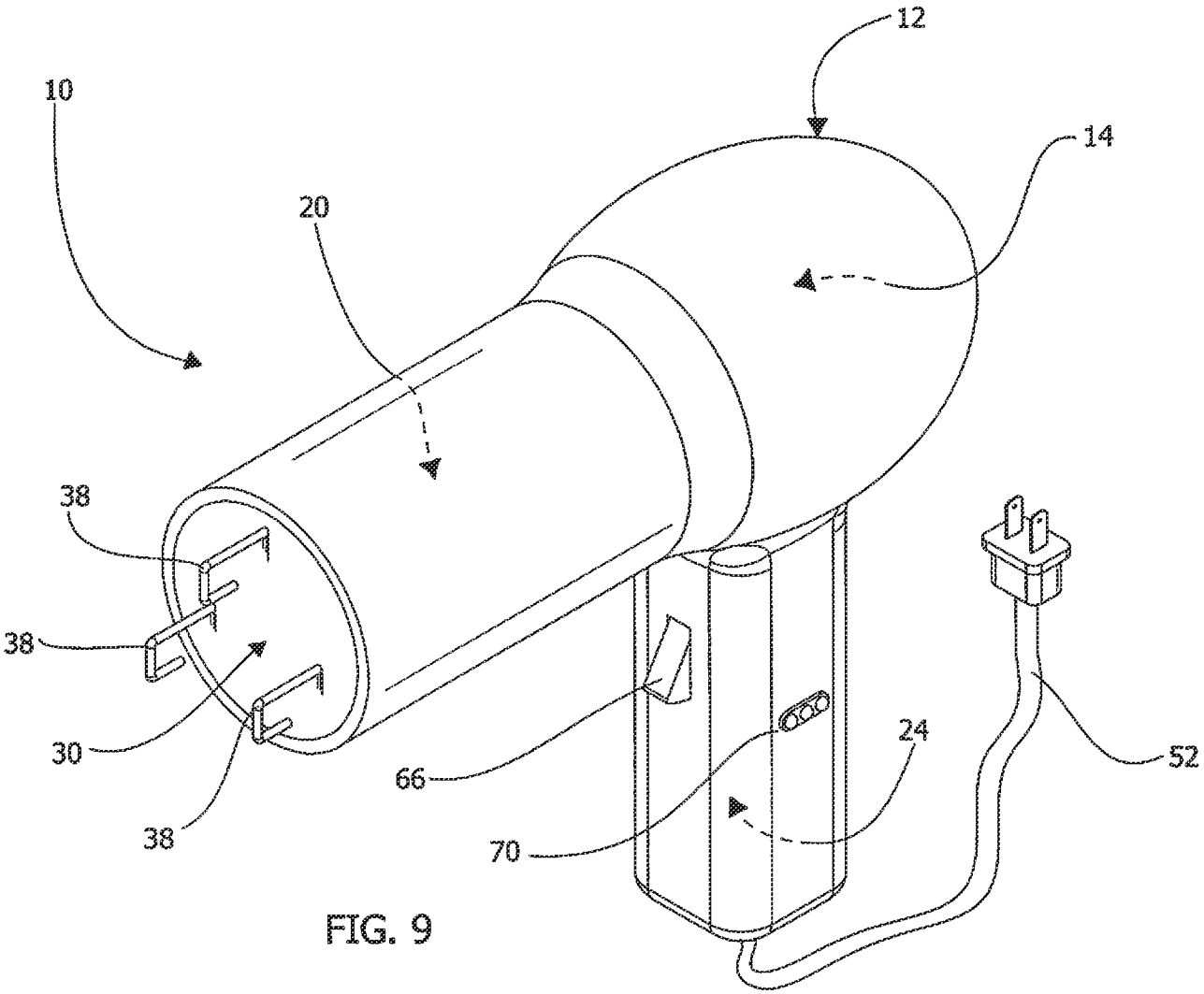
FIG. 9 is an isometric perspective view of an embodiment of the disclosure.
Figure 10:
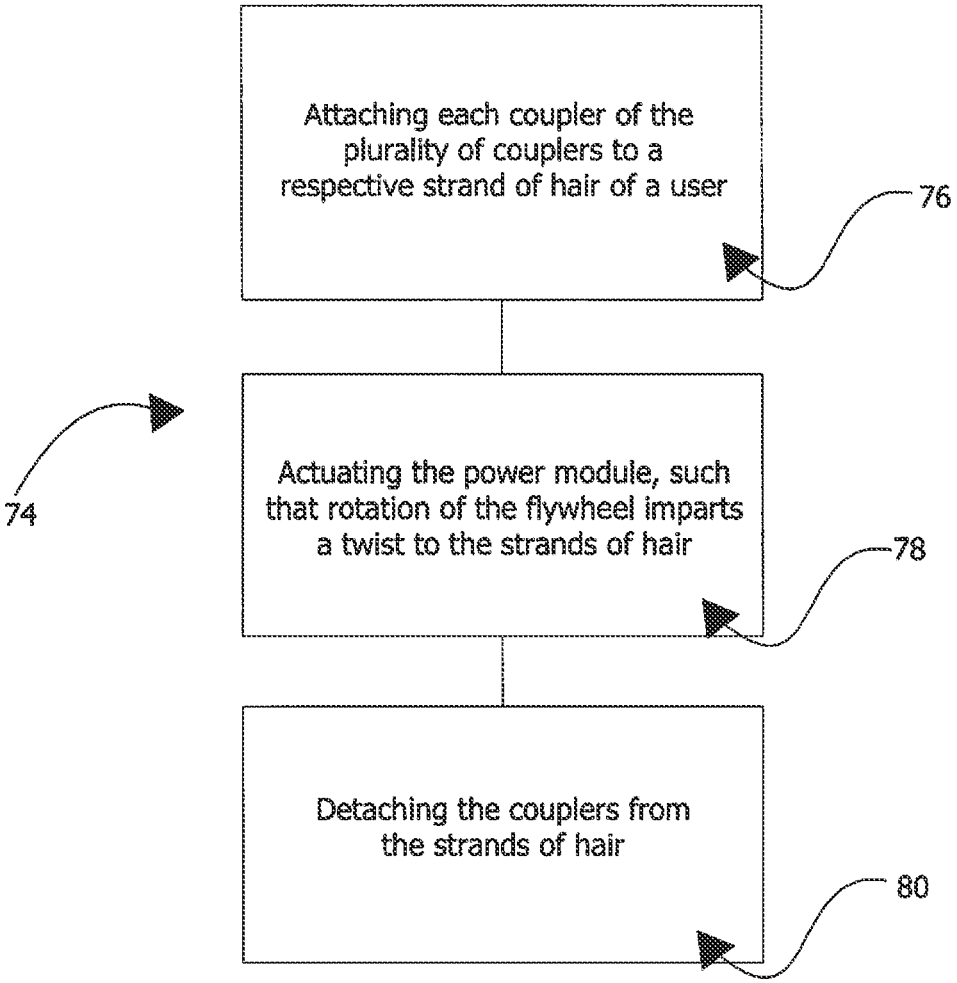
FIG. 10 is a flow diagram for a method utilizing an embodiment of the disclosure.

The power module 22 may comprise a battery 50, as is shown in FIG. 6, or a power cord 52, as is shown in FIG. 9. The power module 22 is configured to selectively power the motor 20 so that rotation of the flywheel 30 imparts a twist to the strands of hair that are attached to the plurality of couplers 36. This automated twisting of the strands of hair relieves a user from performing the twisting manually and can greatly speed of the process.

Figure 8:
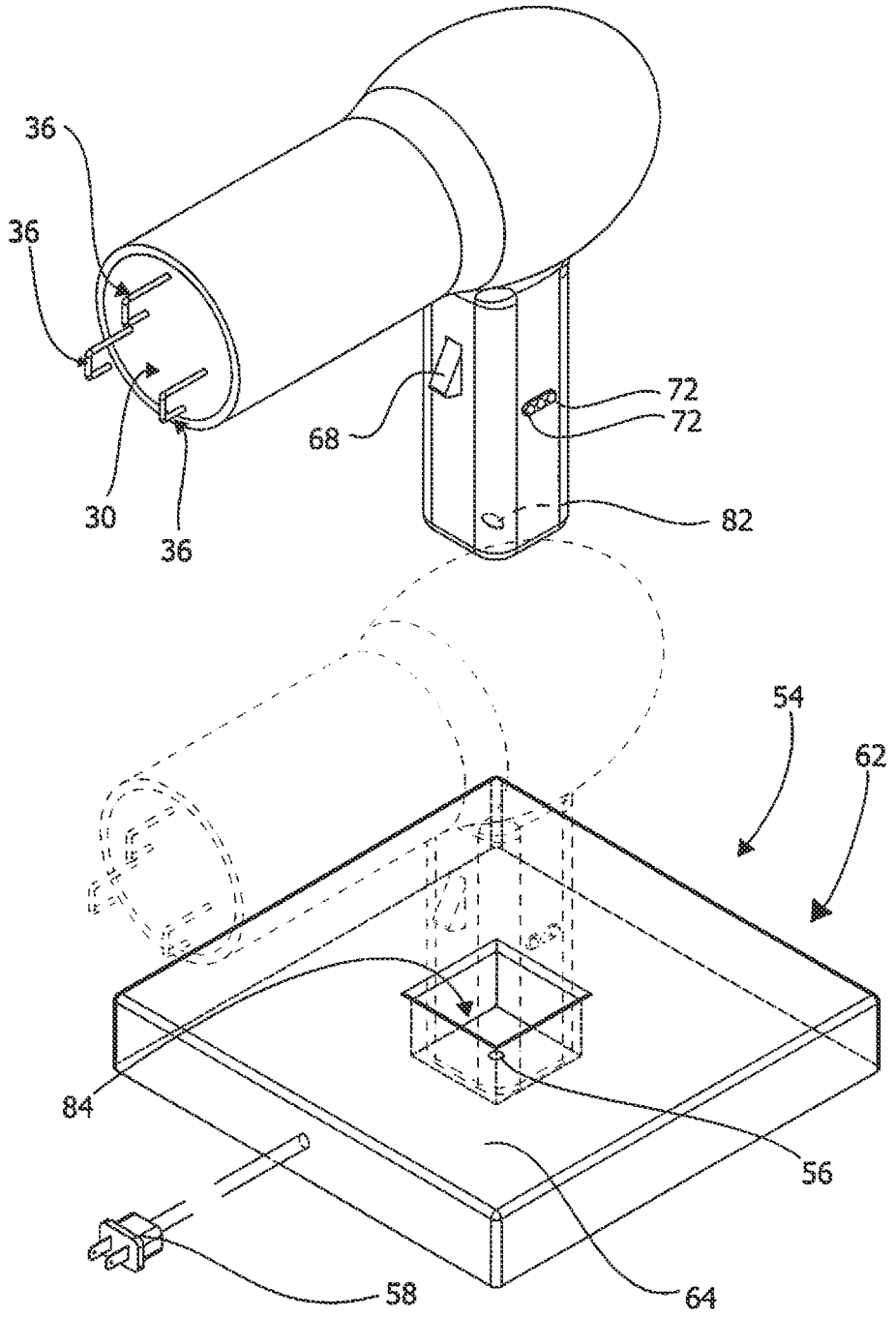
FIG. 8 is an exploded view of an embodiment of the disclosure.

The battery 50 may be rechargeable, although the present invention also anticipates the battery 50 being replaceable. A port 82 is attached to the housing 12 and is operationally engaged to the microprocessor 24. A charging cord 54 has a plug 56, which is complementary to the port 82, and connector 58, which is configured to connect the charging cord 54 to a source of electrical current to charge the battery 50. The port 82 may be attached to a lower end 60 of the grip section 16. The charging cord 54 may be configured as a docking station 62, as is shown in FIG. 8 and which is well known to those skilled in the art of stations for charging handheld devices. The grip section 16 is insertable into a recess 84 in an upper face 64 of the docking station 62 with the plug 56 being attached to the charging station within the recess 84.

The motor 20 is reversible by means of a switch 66, which is attached to the housing 12 and which is operationally engaged to the microprocessor 24. Switching of the switch 66 thus reverses rotation of the motor 20. The switch 66 may comprise a toggle switch 68, or other switching means, such as, but not limited to, slides, toggles, dials, or the like. Being able to switch the motor 20 allows the user to perform twisting of the strands of hair in either direction and to utilize the hair twisting device 10 to untwist strands of hair in a rapid fashion.

A controller 70 is attached to the housing 12 and is operationally engaged to the microprocessor 24, thereby enabling the user to select a speed of rotation of the motor 20. The controller 70 may comprise a plurality of depressible buttons 72, as is shown in FIG. 2, or other controlling means, such as, but not limited to, slides, toggles, dials, or the like. The switch 66 and the controller 70 are attached to the grip section 16 and thus are readily manipulable using digits of the hand grasping the grip section 16.

In use, the hair twisting device 10 enables a method of twisting hair 74, which entails providing the hair twisting device 10, according to the specification above. A first step 76 of the method 74 is attaching each coupler 36 of the plurality of couplers 36 to a respective strand of hair of a user. A second step 78 of the method 74 is actuating the power module 22 so that rotation of the flywheel 30 imparts a twist to the strands of hair. A third step 80 of the method 74 is detaching the couplers 36 from the strands of hair.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hair twisting device comprising:

a housing defining an interior space;

a motor attached to the housing and positioned in the interior space, a shaft of the motor extending to proximate to an orifice positioned in the housing;

a flywheel attached to the shaft, such that the flywheel is rotatable within the orifice;

a plurality of couplers attached to the flywheel, each coupler of the plurality of couplers being configured to attach to a respective strand of hair of a user, such that each coupler is attached to a strand of hair, the plurality of couplers comprising from two to six couplers; and a power module attached to the housing, positioned in the interior space, and being configured to selectively power the motor, such that rotation of the flywheel imparts a twist to the strands of hair attached to the plurality of couplers;

wherein the housing comprises:

a grip section configured to be grasped in a hand of a user, and a tubular section attached to and extending substantially perpendicularly from the grip section;

the flywheel being one of a plurality of flywheels, each flywheel of the plurality of flywheels being fitted with a first connector attached axially to the flywheel;

a second connector attached to the shaft distal from the motor, the second connector being complementary to the first connectors, such that each flywheel of the plurality of flywheels is selectively couplable to the shaft;

wherein the plurality of flywheels comprises:

a first wheel fitted with three couplers, and a second wheel fitted with two couplers;

the power module comprising a battery or a power cord; and a microprocessor attached to the housing, positioned in the interior space, and operationally engaged to the power module and the motor.

2. The hair twisting device of claim 1, wherein each coupler comprises a prong, the prong comprising:

a first section attached to and extending perpendicularly from the flywheel;

a second section attached to and extending perpendicularly from the first section; and a third section attached to and extending perpendicularly from the second section toward the flywheel, such that the prong is hook shaped.

3. The hair twisting device of claim 1, further including:

the motor being reversible; and a switch attached to the housing and operationally engaged to the microprocessor, such that switching of the switch reverses rotation of the motor.

4. The hair twisting device of claim 3, wherein the switch comprises a toggle switch.

5. The hair twisting device of claim 1, further including a controller attached to the housing and operationally engaged to the microprocessor enabling the user to select a speed of rotation of the motor.

6. The hair twisting device of claim 5, wherein the controller comprises a plurality of depressible buttons.

7. The hair twisting device of claim 1, further including:

the battery being rechargeable;

a port attached to the housing and operationally engaged to the microprocessor; and a charging cord having a plug complementary to the port, wherein a connector of the charging cord is configured to connect the charging cord to a source of electrical current to charge the battery.

8. The hair twisting device of claim 7, wherein:

the housing comprises:

a grip section configured to be grasped in a hand of a user; and a tubular section attached to and extending substantially perpendicularly from the grip section;

the port is attached to a lower end of the grip section; and the charging cord is configured as a docking station.

9. A hair twisting device comprising:

a housing defining an interior space, the housing comprising:

a grip section configured to be grasped in a hand of a user; and a tubular section attached to and extending substantially perpendicularly from the grip section;

a motor attached to the housing and positioned in the interior space, the motor being reversible, a shaft of the motor extending to proximate to an orifice positioned in the housing;

a flywheel attached to the shaft, such that the flywheel is rotatable within the orifice, the flywheel being one of a plurality of flywheels, each flywheel of the plurality of flywheels being fitted with a first connector attached axially to the flywheel;

a second connector attached to the shaft distal from the motor, the second connector being complementary to the first connectors, such that each flywheel of the plurality of flywheels is selectively couplable to the shaft;

a plurality of couplers attached to the flywheel, each coupler of the plurality of couplers being configured to attach to a respective strand of hair of a user, such that each coupler is attached to a strand of hair, the plurality of couplers comprising from two to six couplers, each coupler comprising a prong, the prong comprising:

a first section attached to and extending perpendicularly from the flywheel;

a second section attached to and extending perpendicularly from the first section; and a third section attached to and extending perpendicularly from the second section toward the flywheel, such that the prong is hook shaped;

the plurality of flywheels comprising:

a first wheel fitted with three couplers; and a second wheel fitted with two couplers;

a power module attached to the housing, positioned in the interior space, and being configured to selectively power the motor, such that rotation of the flywheel imparts a twist to the strands of hair attached to the plurality of couplers, the power module comprising a battery or a power cord, the battery being rechargeable;

a microprocessor attached to the housing, positioned in the interior space, and operationally engaged to the power module and the motor;

a switch attached to the housing and operationally engaged to the microprocessor, such that switching of the switch reverses rotation of the motor, the switch comprising a toggle switch, the switch being attached to the grip section;

a controller attached to the housing and operationally engaged to the microprocessor enabling the user to select a speed of rotation of the motor, the controller comprising a plurality of depressible buttons, the controller being attached to the grip section;

a port attached to the housing and operationally engaged to the microprocessor, the port being attached to a lower end of the grip section; and a charging cord having a plug complementary to the port, wherein a connector of the charging cord is configured to connect the charging cord to a source of electrical current to charge the battery, the charging cord being configured as a docking station.

* * * * *